US006594929B2

(12) United States Patent
Butcher

(10) Patent No.: US 6,594,929 B2
(45) Date of Patent: Jul. 22, 2003

(54) DISPLAY DEVICE

(76) Inventor: Trevor Butcher, 103 Roman Road, Taunton, Somerset (GB), TA1 2BN ( * ) Notice: Subject to any disclaimer, the term of this patent is extended or adjusted under 35 U.S.C. 154(b) by 0 days.

(21) Appl. No.: 10/075,920

(22) Filed: Feb. 14, 2002

(65) Prior Publication Data

US 2002/0112382 A1 Aug. 22, 2002

(30) Foreign Application Priority Data

Feb. 19, 2001 (GB) ..... 0103923

(51) Int. Cl.[7] ..... G09F 19/00
(52) U.S. Cl. ..... 40/406; 40/435
(58) Field of Search ..... 40/406, 409, 435, 40/433

(56) References Cited

U.S. PATENT DOCUMENTS 5,151,829 A * 9/1992 Hwang ..... 40/406
5,706,594 A * 1/1998 Lin ..... 40/406
6,393,744 B1 * 5/2002 Snyder ..... 40/406

* cited by examiner

*Primary Examiner*—Gary Hoge
(74) *Attorney, Agent, or Firm*—Ira S. Dorman

(57) ABSTRACT

A circular sealed panel 1 includes transparent walls 10–13 separated by spacer rings 14–16 to form intervening sealed chambers 18–20. The chambers are filled with different colored translucent liquids leaving colorless air spaces in each chamber. The panel is supported on friction rollers 2 and 3, one of which is driven by a motor to rotate the panel. The spacer rings 14–16 are formed with cup-like recesses 32 which collect air from the top of each chamber and release it towards the bottom of the chamber so that colorless volumes of air continuously travel upwardly through the chambers thereby presenting continuously moving shapes and color combinations to an observer looking through the panel.

9 Claims, 3 Drawing Sheets

DISPLAY DEVICE

TECHNICAL FIELD OF THE INVENTION

This invention relates to display devices.

BACKGROUND

The present invention seeks to provide a new and inventive form of display device which provides a continuous effect of changing colours.

SUMMARY OF THE INVENTION

The present invention proposes a display device which includes a plurality of superimposed light-transmitting walls defining at least one intervening chamber containing two immiscible fluids which are distinguished by colour, in which the said walls are mounted for rotation about an axis which is substantially normal to their plane, and the or each chamber includes means for collecting fluid at one region of the chamber, carrying it to another region of the chamber and releasing the fluid as the walls rotate.

In the present context the term "distinguished by colour" will be understood to embrace the possibility of at least one of the fluids being colourless, white or black.

The fluids preferably have different densities.

The means for collecting and releasing the fluid preferably includes a plurality of cup-shaped recesses disposed at the periphery of the or each chamber.

In a preferred form of the invention the walls define a plurality of chambers containing fluids with different colour combinations.

BRIEF DESCRIPTION OF THE DRAWINGS

The following description and the accompanying drawings referred to therein are included by way of non-limiting example in order to illustrate how the invention may be put into practice. In the drawings.

DETAILED DESCRIPTION OF THE DRAWINGS

Figure 1:
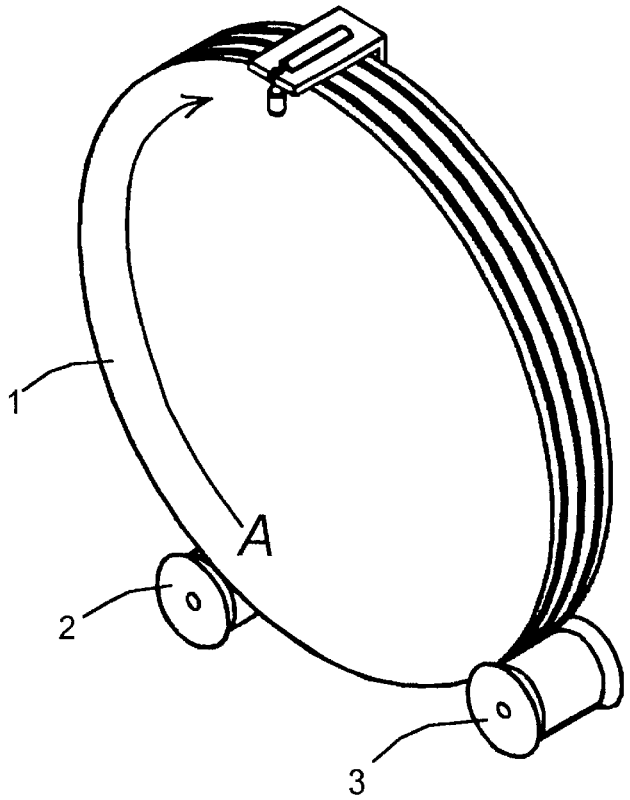
FIG. 1 is a general view of a display panel for use in a changeable colour display in accordance with the invention.
Figure 2:
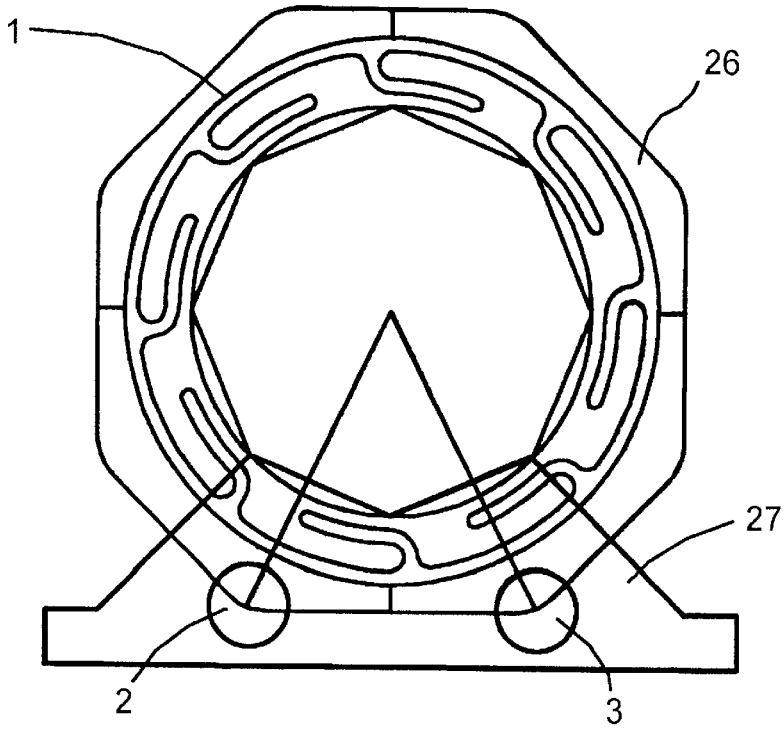
FIG. 2 is a front view of a display device which incorporates the display panel.
Figure 3:
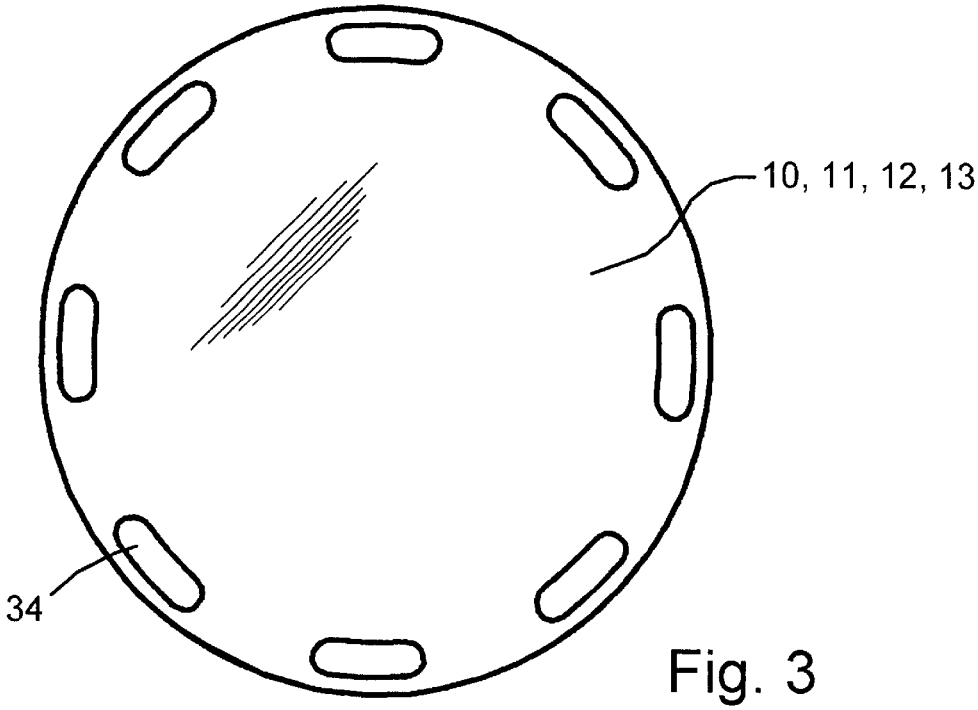
FIG. 3 is a front view of one of the four transparent walls incorporated in the display panel.
Figure 4:
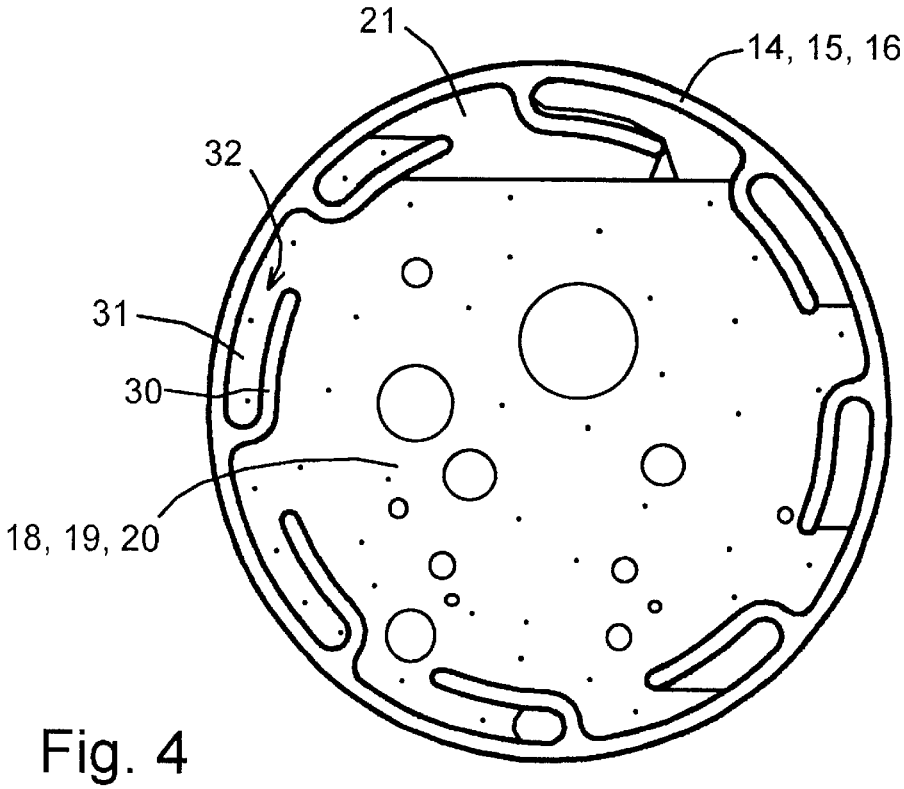
FIG. 4 is front view of one of the spacer rings of the display panel.
Figure 5:
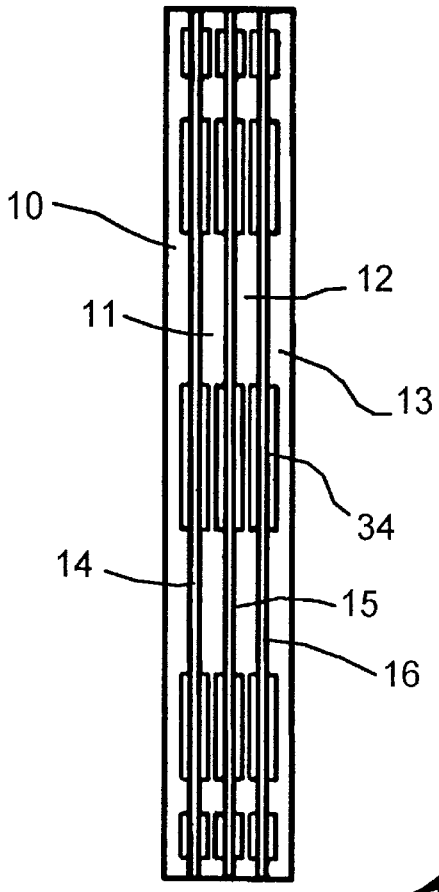
FIG. 5 is a side view of the display panel.
Figure 6:
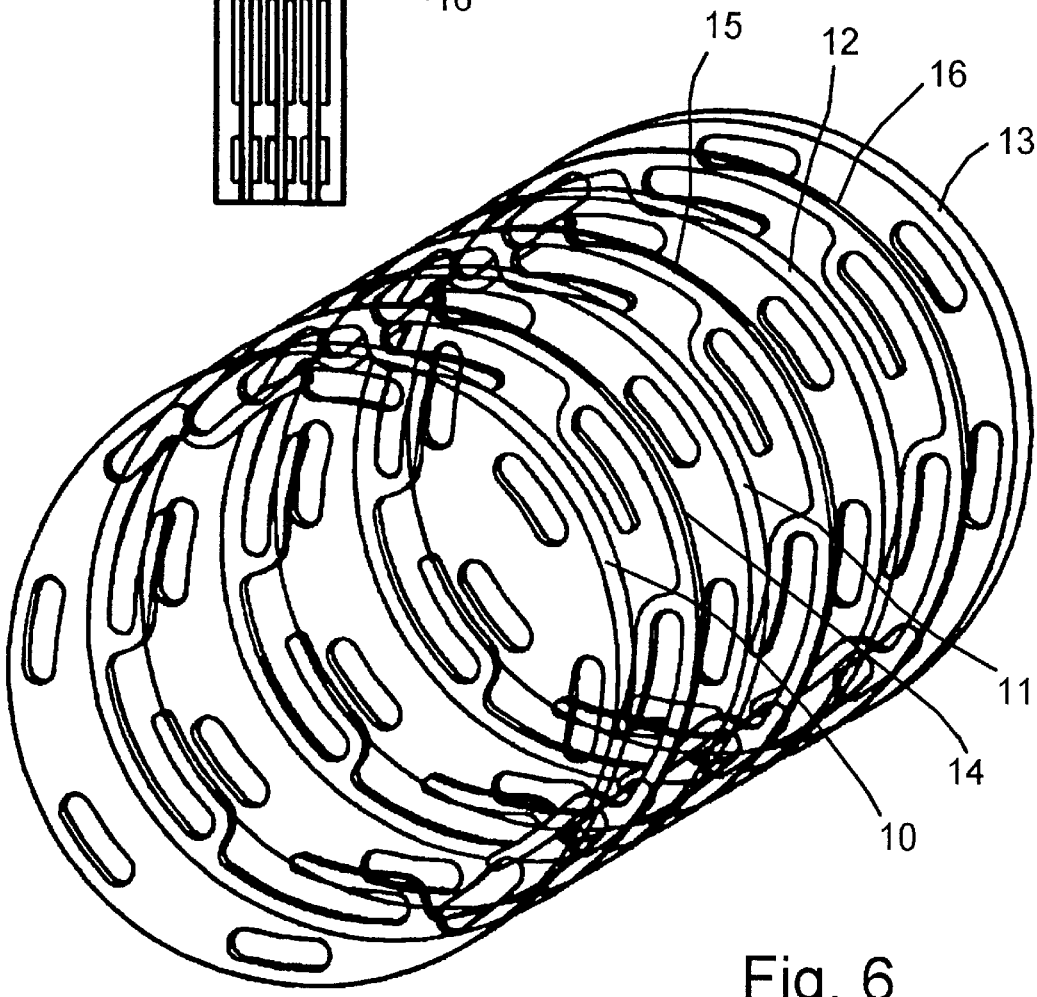
FIG. 6 is a general exploded view of the display panel.

Referring to FIG. 1, the display device includes a circular display panel 1 supported on friction rollers 2 and 3, one of which is driven by an electric motor causing the panel to rotate in the direction of arrow A. The panel 1 may be mounted in a housing 26 as shown in FIG. 2, supported on a base 27. The panel 1 includes four transparent non-coloured plastic disc-shaped walls 10–13 (FIG. 3) separated by spacer rings 14–16 (FIG. 4) with a uniform gap of about 1.5 mm (preferably 1 to 2 mm) forming three substantially circular sealed chambers 18–20. The chambers are filled with different coloured translucent liquids, e.g. cyan, yellow and magenta, leaving an air gap 21 adjacent to the top of each chamber. Low viscosity liquids may be used, e.g. water coloured with ink The spacer rings 14–16 are formed with a series of internal L-shaped projections 30 which are also sealed to the transparent walls 10–13 to form cup-shaped circumferentially extending recesses 31 with mouths 32 which open in the direction of rotation. As can be seen in FIGS. 3, 5 and 6, opposed depressions 34 can be formed in the circular walls 10–13 to increase the capacity of the recesses 31.

The panel 1 is illuminated from behind, either by natural daylight or by means of at least one flourescent tube of the kind which emits white light. To diffuse the light a diffuser screen can be provided between the tube and the panel, or a reflector could be mounted behind the lamp.

As the panel rotates the recesses 31 collect air at the top of the chamber and carry it to the bottom region of the chamber where the air is released. The air then forms discreet flattened colourless bubbles which rise through the coloured liquid and filter the light passing through the panel to present continuously changing shapes and colours to an observer looking through the panel as the bubbles overlap in different combinations.

Other gases or immiscible liquids with different specific gravity could be used instead of air. Heavier liquids will be carried upwards by the cup-like recesses and released while lighter liquids will be carried downwards and released. The panel could be rotated by belt drive or direct drive if desired.

It will be appreciated that the features disclosed herein may be present in any feasible combination. Whilst the above description lays emphasis on those areas which, in combination, are believed to be new, protection is claimed for any inventive combination of the features disclosed herein.

What is claimed is:

1. A display device which includes a plurality of superimposed light-transmitting walls defining at least one intervening chamber containing two immiscible fluids having different densities and which are visually distinguished by the fluid with the greater density being coloured and the less dense fluid being substantially colourless, in which said walls are mounted for rotation about an axis which is substantially normal to their plane, and said chamber includes means for collecting fluid at one region of said chamber, carrying it to another region of said chamber and releasing the fluid as the walls rotate, in which said chamber is substantially filled with the coloured fluid while leaving a gap adjacent to the top of said chamber, which gap contains the less dense fluid, and in which said means for collecting fluid is arranged to collect the less dense fluid from the top of said chamber and release it in a bottom region of said chamber such that discrete, colourless volumes of the less dense fluid move upwardly through the coloured fluid.

2. A display device according to claim 1, in which the coloured fluid is a liquid and the less dense fluid is a gas.

3. A display device according to claim 1, in which the walls define a plurality of chambers containing fluids with different colour combinations.

4. A display device according to claim 1, in which the walls are incorporated in a sealed circular display panel.

5. A display device according to claim 4, in which the display panel is rotatably supported on at least two rotatable support elements.

6. A display device according to claim 5, in which the support elements include friction rollers.

7. A display according to claim 1, in which the periphery of said chamber is defined by a spacer ring which is interposed between a pair of said walls, forming therewith a sealed chamber.

8. A display device according to claim 7, in which the means for collecting the fluid includes a plurality of cup-like recesses formed in said spacer ring.

9. A display device according to claim 8, in which each of the recesses extends substantially circumferentially of said spacer ring, and in which the less dense fluid is collected and released through a mouth at a leading end of each recess.

* * * * *